US006832618B2

(12) United States Patent
DeHart

(10) Patent No.: US 6,832,618 B2
(45) Date of Patent: Dec. 21, 2004

(54) DINING TABLE WITH INTEGRAL DISHWASHER

(76) Inventor: Harold F. DeHart, 5512 Redwood Rd., Durham, NC (US) 27704

( * ) Notice: Subject to any disclaimer, the term of this patent is extended or adjusted under 35 U.S.C. 154(b) by 142 days.

(21) Appl. No.: 10/378,511

(22) Filed: Mar. 3, 2003

(65) Prior Publication Data

US 2004/0173250 A1 Sep. 9, 2004

(51) Int. Cl.[7] ..... A47L 15/42

(52) U.S. Cl. ..... 134/115 R; 134/200; 134/201; 134/88; 134/89; 312/312

(58) Field of Search ..... 134/115 R, 201, 134/88, 898, 200; 312/228

(56) References Cited

U.S. PATENT DOCUMENTS

| | | | | | |
|---|---|---|---|---|---|
| 1,375,506 | A | * | 4/1921 | Gray | 494/56 |
| 1,583,657 | A | * | 5/1926 | Chapman | 134/176 |
| 1,952,568 | A | * | 3/1934 | Schapp et al. | 134/105 |
| 2,045,890 | A | * | 6/1936 | Uhalt et al. | 134/105 |
| 2,502,265 | A | * | 3/1950 | Macon | 134/115 R |
| 2,750,611 | A | * | 6/1956 | Bertrand | 15/74 |
| 2,782,426 | A | | 2/1957 | Townsend | |
| 2,844,432 | A | * | 7/1958 | Freer | 312/228 |
| 2,868,837 | A | * | 1/1959 | Burland et al. | 562/596 |
| 2,971,519 | A | * | 2/1961 | Willson | 134/58 D |
| 3,075,215 | A | * | 1/1963 | Marue | 15/77 |
| 3,152,599 | A | * | 10/1964 | Grimes | 134/115 R |
| 3,694,046 | A | * | 9/1972 | Gehrmann | 312/196 |
| 4,296,768 | A | * | 10/1981 | Saucedo | 134/47 |
| 5,678,752 | A | * | 10/1997 | Kaminsky et al. | 228/223 |
| 5,687,752 | A | | 11/1997 | Boylan | |
| 6,095,165 | A | * | 8/2000 | Mastronardi | 134/115 R |
| 6,241,330 | B1 | * | 6/2001 | Lye et al. | 312/140.4 |
| 6,378,537 | B1 | | 4/2002 | DeHart | |

FOREIGN PATENT DOCUMENTS

| | | | |
|---|---|---|---|
| DE | 29 38 176 | * | 4/1981 |
| FR | 94854 | * | 4/1983 |
| FR | 2605201 | * | 4/1988 |
| JP | 2-213307 | * | 8/1990 |

* cited by examiner

*Primary Examiner*—Frankie L. Stinson
(74) *Attorney, Agent, or Firm*—B. B. Olive

(57) ABSTRACT

The dining table comprises a table structure having one or more openings adapted to receive in a snug fit either a dining tray or a pair of operatively associated access covers, which in either case fill the opening. An inner one of the access covers is connected to the table structure by a hinge and an outer one of the access covers is suspended by a lever and latching arrangement. In a raised position, the covers abut each other and provide a substantially smooth dining surface. In a lower position, the covers are stored below the dining tray.

11 Claims, 9 Drawing Sheets

DINING TABLE WITH INTEGRAL DISHWASHER

This invention relates to a combination dining table-dishwasher apparatus, and more particularly to improvements to the type of dining table-dishwasher apparatus shown in Applicant's prior U.S. Pat. No. 6,378,537 entitled "Dining Table With Integral Dishwasher" issued Apr. 30, 2002.

BACKGROUND OF THE INVENTION

Most contemporary homes have an automatic dishwasher that is installed beneath a counter surface in the home's kitchen in place of a storage cabinet. With such a dishwasher arrangement, dishes must be removed from the eating table and carried to the dishwasher to be washed. Frequently, similar types of dishes, e.g. dinner plate, salad bowl, etc., are used for many meals. After the dishes are washed, and before a subsequent meal is eaten, the dishes must be moved again to the table. In this arrangement, not only does the dishwasher occupy kitchen space that could otherwise be used for storage but also one must move the dishes back and forth between the counter and the table.

In some homes, a dishwasher is portable, that is, not installed at all, but moveable about the kitchen floor. A portable dishwasher solves the storage space drawback of the built-in dishwasher noted above, but it occupies extra and much desired additional floor space. If the portable dishwasher is located near the kitchen sink, it again requires transporting the dishes to and from the table for washing. If the portable dishwasher is located near the table, then a power cord, a water line, and a waste line need to traverse from a wall source across the kitchen floor, which acts to further reduce desired kitchen space.

It is also known to position a dishwasher beneath the dining surface of a table in the kitchen, thus overcoming all the obstacles of the conventional built-in as well as portable dishwashers as discussed above. The typical dining table covers an open area of unused space. The dining table is, by definition, the venue for eating. Placing a dishwasher device under a dining table avoids the need to transport the dishes to and from the table, allows more space beneath the kitchen counter for storage, and does not require electric and water lines to traverse the kitchen floor, since they can be routed directly from below the table.

In addition to the benefits derived from a dishwasher that is built into a dining table as noted above, such an arrangement is of particular benefit to physically handicapped and elderly persons who have more than average difficulty with the task of moving dishes between a table and a dishwasher.

A washing apparatus built into a dining table is disclosed in U.S. Pat. No. 1,952,568 to Schapp et al., issued Mar. 27, 1934, for a "Convertible Dishwashing Dinner Table". The Schapp et al. disclosure includes a series of eating trays that mount into the surface of the table. The trays may be formed with cavities to receive food. The user attaches utensils and dishes to clips on the trays and inverts the tray so that its eating surface faces down for being washed. The non-eating surface does not get washed.

A further washing apparatus in a dining table is taught in U.S. Pat. No. 2,782,426 to Townsend, issued Feb. 16, 1957, for a "Table Having Reversible Tray Mounted Therein And Means For Washing The Same". The Townsend table incorporates trays into its top surface. The trays are moveable from an eating position to a washing position by rotating around a mounting shaft. Again, only the eating surface is subject to being washed.

An additional combination dining table and dishwashing apparatus is shown in U.S. Pat. No. 2,971,519 to Willson, issued Feb. 14, 1961, entitled "Combined Dining Table And Dishwasher". The apparatus of Willson provides a dish and utensil compartment within a storage base of the table. A dishwashing unit operates to wash the dishes that are placed on holders in the compartment. The Willson patent does not incorporate a tray component.

A still further combination dishwasher and dining table is disclosed in U.S. Pat. No. 5,687,752 to Boylan, issued Nov. 18, 1997, entitled "Dining Table Having Integral Dishwasher". The device of the Boylan patent has a washing basin with a vertically shiftable rack assembly for carrying dishes. A shifting mechanism is coupled with the rack assembly for shifting the rack between a position below the tabletop to a position above the tabletop. A lid is carried up and down with the rack by the shifting mechanism. However, the apparatus described in the Boylan patent appears to open up the undesired possibility of discharging water onto the tabletop if opened at the wrong time and also lacks a necessary eating tray.

The combination dining table-dishwasher apparatus of the type described in Applicant's prior U.S. Pat. No. 6,378,537, issued Apr. 30, 2002 entitled "Dining Table With Integral Dishwasher", has brought about numerous improvements over the prior art described above. The combination dining table suitable for use by either one or two persons and with an integral dishwasher apparatus for each as illustrated in the '537 patent incorporates hinged-together pairs of inner and outer access covers over a dishwasher. In a first position, each pair of access covers are stored one above the other and an eating tray used for dining is loosely mounted above the stored access covers. In a second position, the hinged-together pair of inner and outer access covers are positioned over the dishwasher in a coplanar relation and form a surface, which in lieu of using the dining tray can be used for dining or as a work surface in the mentioned first position.

With the above as background, Applicant has discovered, through use of the '537 patent apparatus, a need to improve: a) the smoothness of the dining/work surfaces established by the inner and outer access covers when in place over the dishwasher apparatus; b) the mechanism used to support and position the inner and outer access cover; and c) the ease of operation of such mechanism.

Thus, the principal object of the present invention as distinct from the prior invention described in the '537 patent is to provide a relatively smooth dining/work surface when its access covers are in a closed position so as to provide a more easily cleaned dining/work surface and therefore a more sanitary surface when the inner and outer access covers are in a closed position over the dishwasher apparatus.

Another object of the present invention, is to provide a dining table with an integral dishwasher that is easy to open, close and operate by those with physical problems, e.g. arthritis of the hands and/or fingers.

Objects of the prior invention as recited in Applicant's prior '537 patent also become objects of the present invention.

It is an additional object of the present invention to provide a dining table with an integral dishwasher that is more aesthetically pleasing.

Yet another object of the present invention is to provide a dining table with an integral dishwasher that is very economical to manufacture.

The foregoing and other objects of the present invention will become more apparent through the disclosure of the invention to follow.

SUMMARY OF THE INVENTION

The present invention incorporates many of the desirable features of the combination dining table-dishwasher apparatus described in applicant's previously issued U.S. Pat. No. 6,378,537. The present invention provides a dining table, whose inner and outer access covers can be positioned so as to establish a top surface that is substantially free of any obstructions and is most useful as a food preparation surface as well as a surface upon which to eat. The invention apparatus incorporates at each dining location a pair of two-piece, inner and outer access cover structures, which are easily openable and when open give access to an eating tray and eating utensils and dishes stored within the combined dining table and integral dishwasher cabinet structure. Each inner and outer access cover operates independent of the other through a novel hinge arrangement for the inner access cover and a novel release locking arrangement and mechanism for the outer access cover. The release mechanism allows the outer one of each pair of access cover members to move from an uppermost position to a lowermost position. When the outer access cover reaches this lowermost position it causes the other inner access cover member to be tilted upward slightly. The user can then easily grasp the tilted inner cover member and move it into its open position at which time the locking mechanism maintains both cover members in an open position and allows an eating tray to be withdrawn from within the dishwasher cabinet structure. After eating, the dishes and utensils are placed within a dishwashing chute within the integral dishwasher cabinet structure, the eating tray is moved back into the dishwashing apparatus, and the locking mechanism is released, which allows each of the access cover members to move from its respective open position to its respective closed position and so as to permit the dishwasher mechanism to be activated for washing the tray, dishes and utensils stored therein.

BRIEF DESCRIPTION OF THE DRAWINGS

In order for the invention to become more clearly understood it will be disclosed in greater detail with reference to the accompanying drawings, in which.

DETAILED DESCRIPTION

The description is first directed primarily to the subject matter of Applicant's prior U.S. Pat. No. 6,378,537 and later to the specific improvements, which are the subject matter of the present invention. Much of the beginning description will necessarily repeat description of the '537 patent, whereas the later description will describe those improvements, which constitute the present invention.

Figure 1:
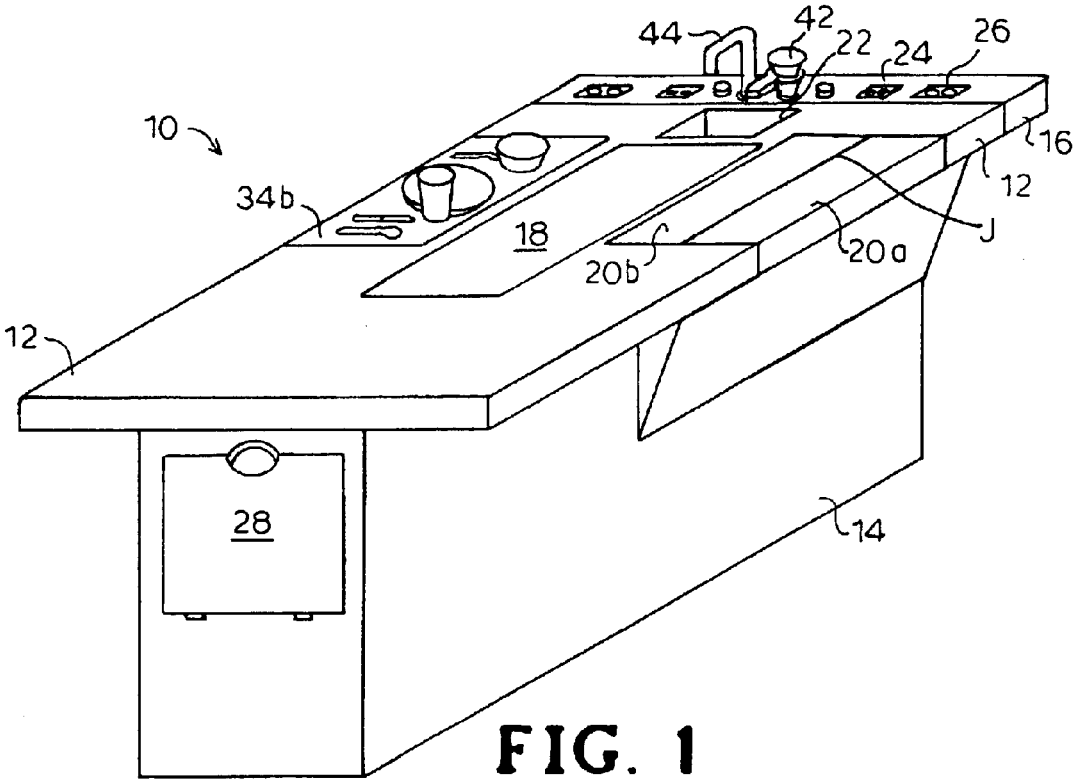
FIG. 1 is a perspective illustration of the dining table of the present invention including an integral dishwasher apparatus for use by each of two persons and illustrating a pair of inner and outer dishwasher access covers closed and forming a relatively smooth surface suited as a work or dining surface.

In accordance with the objects disclosed above, FIG. 1 illustrates improved table 10 of the present invention including an integral dishwasher. Table 10 is formed generally of a top portion comprised of dining surface 12 and control panel 16 mounted on support base 14. Since the present invention was developed for reasons of aesthetics, efficiency, more sanitary eating area, and ease of use, table 10 is substantially permanently mounted in a selected location, and a water line, a waste line, and electric line (not shown) are appropriately connected to the enclosed dishwasher unit. Dining surface 12 contains sink 22 and control panel 16, which has electrical outlet 26 and a series of dials 24 or switches for operating the dishwasher and an optional warming surface 18. A heating element 18' is located beneath warming surface 18 (see FIG. 2). Additional optional controls, such as room lights or television, may be similarly installed in control panel 16. It is to be noted that the rectangular shape of table 10 is shown as an example, and other shapes, for example circular, would also satisfy the criteria of the present invention.

Since the respective outer and inner access covers 20*a*, 20*b* in conjunction with eating tray 34*a* are constructed and operate in the same way as outer and inner access covers 20*c*, 20*d*, in conjunction with eating tray 34*b*, the description only refers to and describes the improved construction of the present invention in reference to the respective outer and inner access covers 20*a*, 20*b* and eating tray 34*a*.

Figure 2:
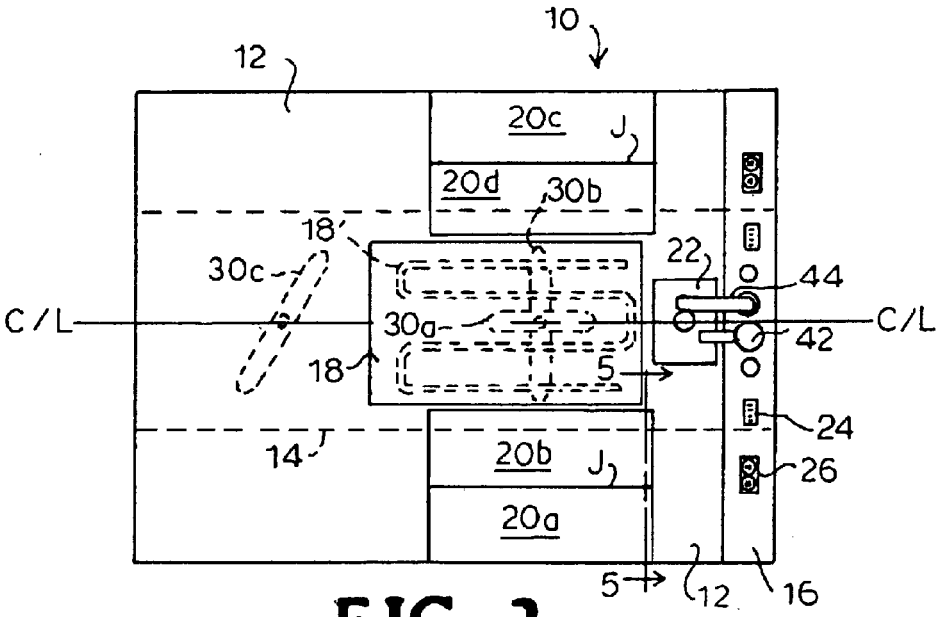
FIG. 2 is a top plan view of the FIG. 1 invention dining table with an integral dishwasher on each of two sides and with the pair of inner and outer access covers on each side and forming a relatively smooth dining/work surface.
Figure 3:
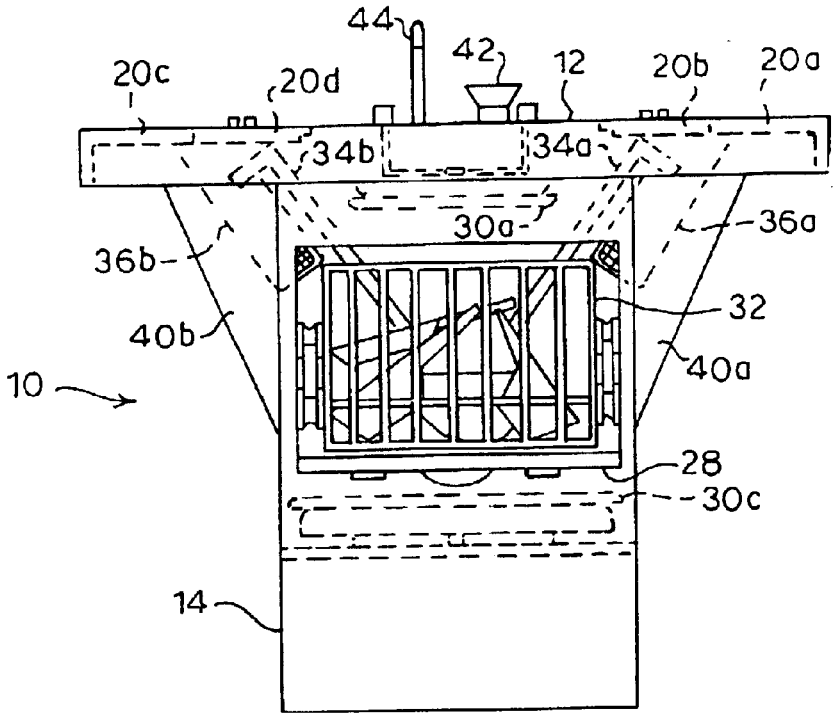
FIG. 3 is an end view of the present invention with an access door to a pot-cleaning basket in the open position.
Figure 8:
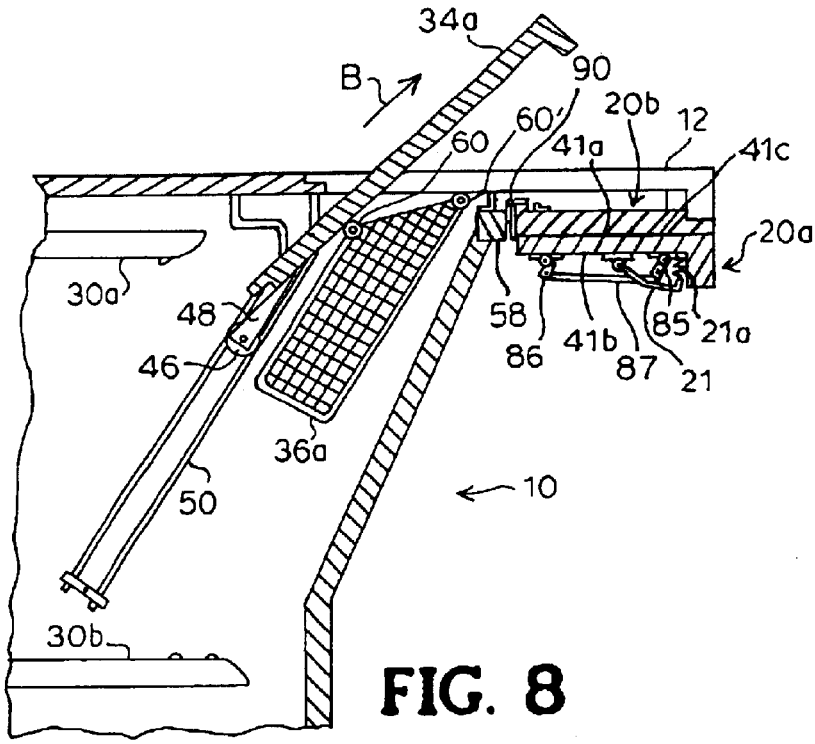
FIG. 8 is the view of FIG. 5 with the outer and inner access cover members both fully opened and the eating tray withdrawn approximately halfway from within the dishwasher.
Figure 9:
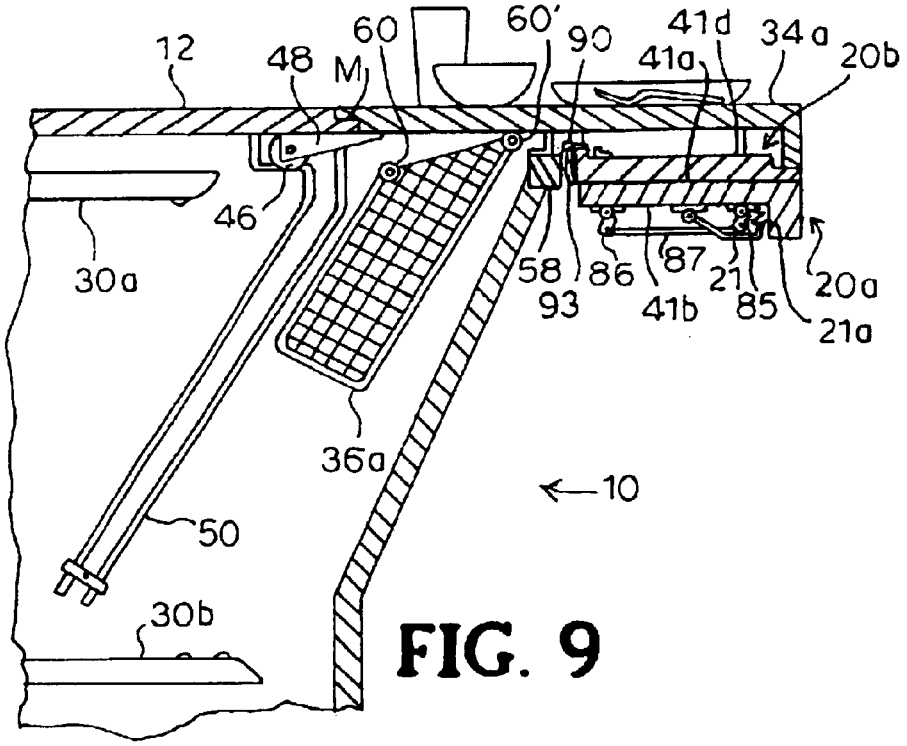
FIG. 9 is the view of FIG. 5 with the outer and inner access cover members fully opened and with the eating tray completely withdrawn from the dishwasher and in an operative position for eating, with illustrative dishes and utensils placed thereon for use.
Figure 10:
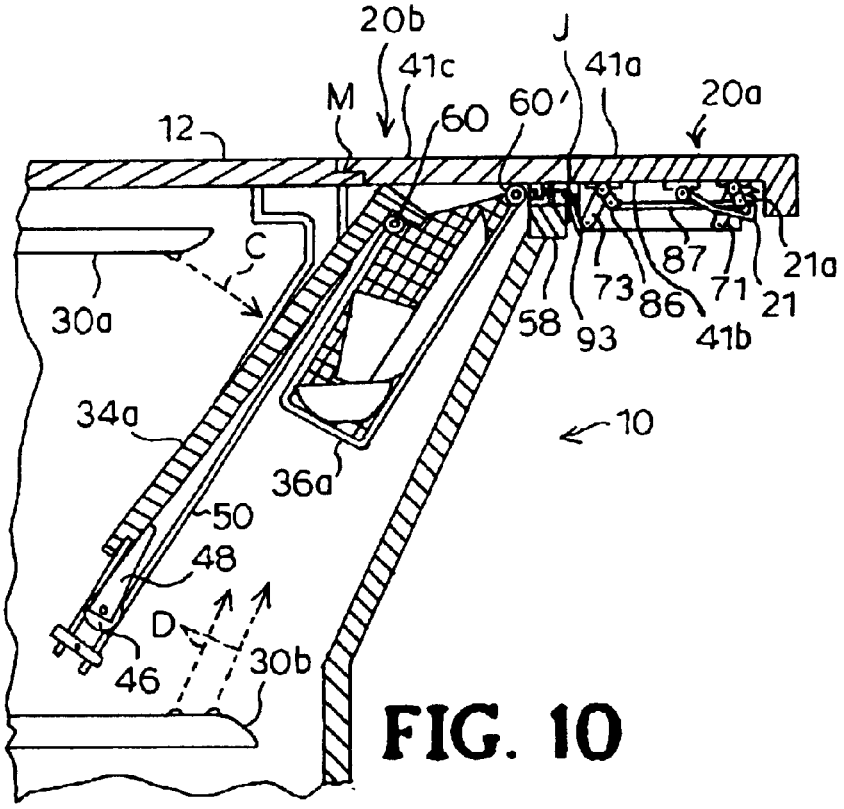
FIG. 10 is the view of FIG. 5 with the outer and inner access cover members fully closed, and with the eating tray, dishes, and utensils enclosed within the dishwasher for washing.

While dining surface 12 could be configured to accommodate a single individual, dining surface 12 is illustrated in the preferred embodiment configured to accommodate at least two people as in FIGS. 1–4. Accordingly, a first outer access cover 20*a* is in a position suited to a first person being seated at table 10. A second inner access cover member 20*b* operates in conjunction with outer access cover 20*a* and both are stored beneath the plane of eating surface 12 when eating tray 34*a* is positioned in their place as in FIG. 9. Also to be noted is that when tray 34*a* is positioned, as in FIG. 9, its top surface is substantially flush with the top of dining surface 12 and is illustrated in FIG. 9 with a typical set of dishes and utensils placed for use. Note should also be taken that table 10 is sized as best seen in FIG. 2 to accommodate additional people being seated near its left end as viewed in FIGS. 1 and 2. The respective outer and inner access covers 20*a* and 20*b* are adapted to be positioned so as to either cover (as in FIGS. 1, 2, 3, or 10) or uncover (as in FIGS. 7–8) the operative portion of the dishwasher below. As further explained below, one side of table 10 is fitted with a respective pair of outer and inner access covers 20*a*, 20*b*, and the opposite side of table 10 is fitted with a comparable pair of outer and inner access covers 20*c*, 20*d*. The respective outer access covers 20*a* and 20*c* basically have two parallel positions, high and low. The high position places their respective surfaces in the same plane as that of the dining surface 12, as shown in FIGS. 1, 3, and 10. The respective low position of outer access cover 20*a* is illustrated in FIGS. 5, 6, 7, 8, and 9. The outer access covers 20*a*, 20*c* are supported, positioned, latched, and unlatched by the later-explained mechanism.

By contrast, with regard to the manner in which the outer access covers 20*a*, 20*c* are supported, positioned, latched, and unlatched, the inner access covers 20*b* and 20*d* are supported and pivotally positioned by means of hinge 90 secured to the body structure 58 of table 10. Thus, inner access cover 20*b* can lie flat as in FIGS. 1 and 5 and have its upper surface in the same plane as that of dining surface 12, or it can be pivoted on its hinge 90, be inverted, and reside on top of access cover 20*a* as in FIG. 8. With this preliminary introduction to the outer and inner access covers and their operation, the description now continues with other aspects of the invention.

Figure 4:
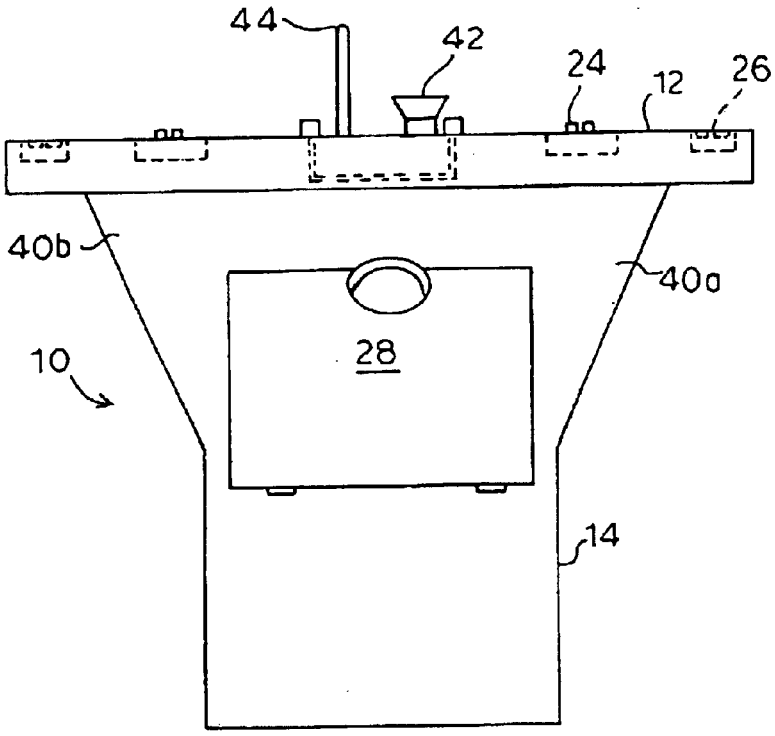
FIG. 4 is an end view of the present invention with the access doors closed.

Sink 22 is equipped with an electrically heated water spigot 42 (well known to one skilled in this field) for making instant coffee, tea or soup, in addition to the usual water connection 44. A pot insertion door 28 is located at the left end (as seen in FIGS. 1, 3, and 4) of supporting base 14 for placing larger cooking and serving utensils into the dishwasher unit of the invention. Here it should be noted that with respect to access cover members 20*a*, 20*b*, 20*c*, and 20*d* that the improvements to which the present invention relate are directed primarily to the means employed for supporting and positioning the respective access cover members 20*a*, 20*b*, 20*c*, and 20*d*, in a manner which permits the access covers, when closed, to form a very smooth dining surface as best explained in reference to later-referred to FIGS. 5–14.

Referring now to FIG. 2, improved dining table 10 of the present invention is shown in top plan view with certain of the internal components illustrated in dashed lines. Dishwashing water-distributor arm 30*a*, tray-washing water-distributor arm 30*b* and pot-washing water-distributor arm 30*c* are positioned within support base 14 in separated, vertically spaced locations along a substantially central line C/L that is parallel to the long dimension of the invention dining table with integral dishwasher. Tray-washing water-distributor arm 30*a* is relatively small and is positioned substantially high, and dishwashing water-distributor arm 30*b* is relatively large and is positioned substantially low, as best seen in FIGS. 5–10. Warming surface 18, in which heating element 18' is enclosed, is located in dining surface 12, in a location between the pair of outer and inner access covers 20*a*, 20*b* and the opposite pair of outer and inner access covers 20*c*, 20*d*. Warming surface 18 is preferably of a different appearance than dining surface 12 for visibility and safety reasons.

Figure 5:
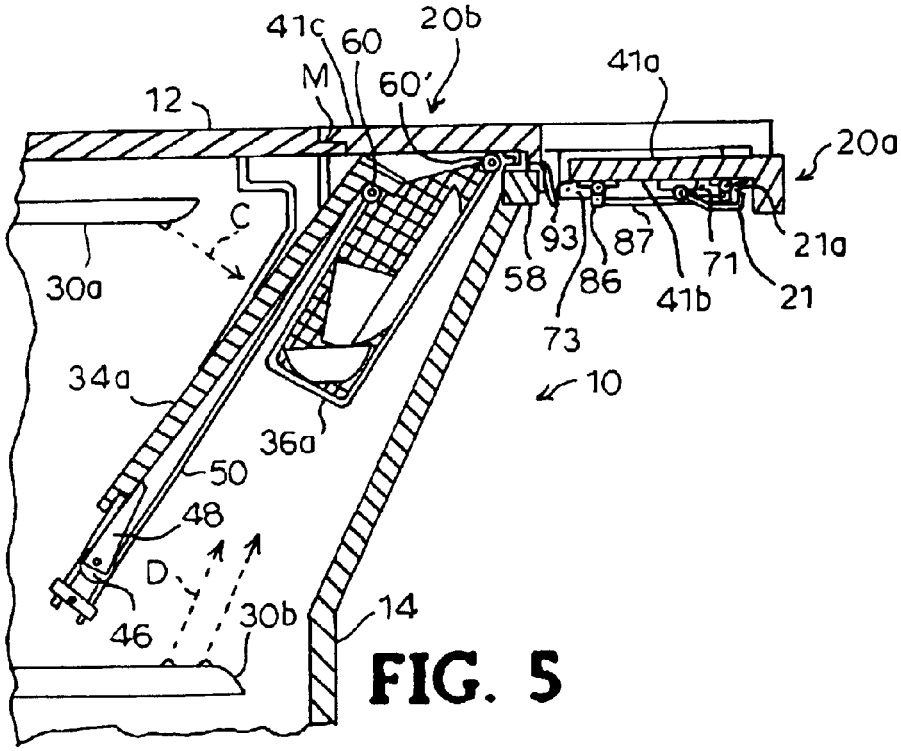
FIG. 5 is a partial sectional view of the dining table with integral dishwasher taken in the direction of line 5—5 of FIG. 2 and showing an inner access cover member positioned in its closed position.

Referring now to FIG. 3, an end elevation view of the relation of angularly oriented, perforate chutes 36*a* and 36*b* is shown dashed in and with pot insertion door 28 in an open position. The upper right and left side panels 40*a*, 40*b* on the right and left sides (as shown in FIG. 3) of support base 14 are oriented angularly to accommodate the shape of perforate chutes 36*a* and 36*b*, thus maximizing the space available for the knees of the users. Chutes 36*a* and 36*b* provide a mesh housing for dishes and utensils through which water can pass to permit thorough washing, see FIGS. 5–10. A pair of eating trays 34*a* and 34*b* is shown in FIGS. 3 and 5 in their stored locations in chutes 36*a* and 36*b* respectively within support base 14. When the respective outer and inner access covers 20*a,* 20*b* and/or the respective outer and inner access covers 20*c,* 20*d* are open, as in FIG. 8, one may reach through the opening formed and retrieve eating trays 34*a* and/or 34*b* respectively, for use as indicated in FIG. 8. Here it may be noted that when both eating tray 34*a* is stored for washing and access covers 20*a,* 20*b* are stored, the inner end of the opening provided overlies and gives access to the dishwasher, whereas the outer end of the opening overlies and gives access to the stored access covers. Eating trays 34*a* and 34*b* are configured to fit within either of the openings in dining surface 12, which receives the access covers 20*a,* 20*b* or 20*c,* 20*d* when closed and to be supported so as to reside substantially flush with the plane of dining surface 12 when in their respective operating locations in such openings. At the completion of a meal, eating trays 34*a* and 34*b* are placed in their respective storage locations adjacent dishwashing chutes 36*a* and 36*b,* where dishes are placed for washing, see FIG. 10. When all dishes and trays are in their respective positions for washing, access cover members 20*a,* 20*b* and/or 20*c,* 20*d* are closed securely. The dishwasher unit is operated to wash trays 34*a* and 34*b* along with the dishes that have been placed in chutes 36*a* and 36*b.*

FIG. 4 shows an end view of dining table 10 with integral dishwasher as seen in FIG. 3, but with pot insertion door 28 closed, ready for a washing cycle for the pots and pans. The space within table 10 behind door 28 also serves as a storage area for pots and pans when not in use.

FIGS. 5–14 illustrate the operation of the outer and inner access cover support and positioning mechanism of the present improved invention through a series of sequential positions of the respective outer and inner access covers 20*a,* 20*b* and outer and inner access covers 20*c,* 20*d* and eating trays 34*a,* 34*b.* For purposes of illustration and explanation hereafter, only access cover members 20*a,* 20*b* and eating tray 34*a* will be described in detail with reference to FIGS. 5–14. As previously mentioned, the pair of outer and inner access covers 20*a,* 20*b* and eating tray 34*a* are adapted to occupy the same opening in dining surface 12, but at alternate times.

Figure 6:
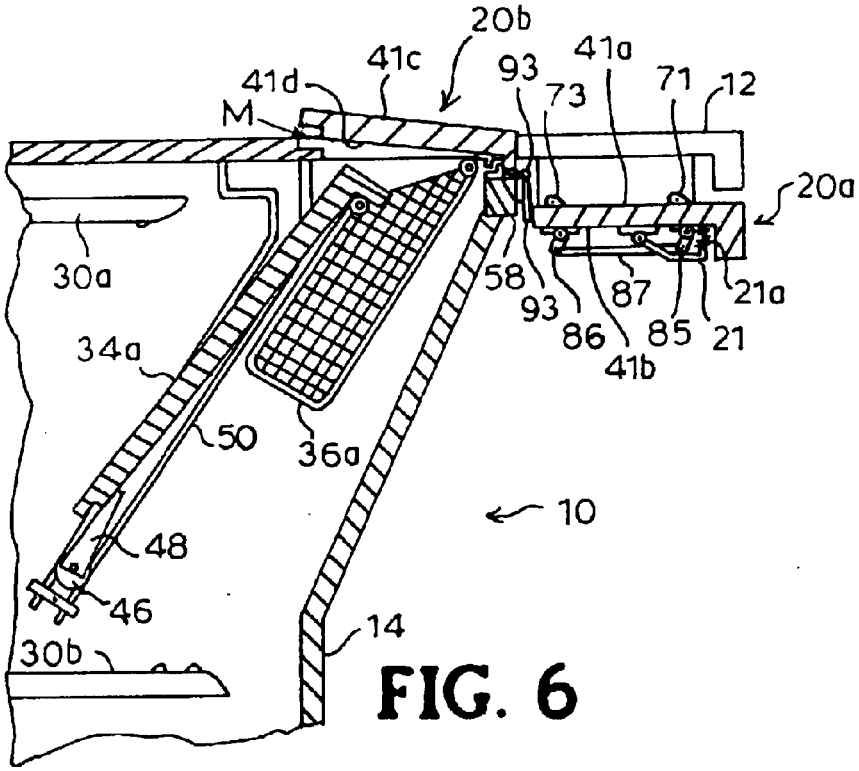
FIG. 6 is the view of FIG. 5 with the outer access cover member fully opened, the inner access cover member tilted and partly opened by action of the outer access cover, and an eating tray in a storage position within the dishwasher.

As more general background, and as a reference for the further-detailed description to follow, it may be noted that with the improved construction of the present invention outer access cover 20*a* is mounted in such a way that while maintaining itself in a substantially horizontal position, it can move somewhat outwardly, downwardly, and then somewhat inwardly from a high position illustrated in FIGS. 1 and 10 to a low position illustrated in FIG. 6, and in which low position it receives and effectively supports the inner access cover 20*b,* as illustrated in FIG. 8. Access cover 20*a*'s mounting arrangement also enables access cover 20*a,* while remaining in a substantially horizontal position, to move somewhat outwardly and vertically (see FIG. 5) from its low position illustrated in FIG. 6 and then somewhat inwardly to its high position illustrated in FIGS. 1 and 10. In outer access cover 20*a*'s high position, its inner edge abuts the outer edge of inner access cover 20*b* as illustrated in FIGS. 1 and 10. When outer access cover 20*a* is in such high position, as in FIGS. 1 and 10, its top surface resides in the same plane as is occupied by the top surface of dining surface 12 as illustrated in FIG. 10. As later explained, the improved construction of the present invention also enables the outer access cover 20*a* to be very easily latched and unlatched when in its high position.

Outer and inner access covers 20*a* and 20*b* are not hinged together as in Applicant's '537 patent. Unlike outer access cover 20*a,* inner access cover 20*b,* as previously mentioned, is hinged along its outer edge by means of hinge 90 to a fixed bar member 58, and thus can be pivoted from a low position, illustrated in FIG. 8, in which low position inner access cover 20*b* resides on and is supported by outer access cover 20*a* to a high position, as in FIG. 10. When inner access cover 20*b* is in such high position, as in FIG. 10, its inner edge abuts a mating outer edge of dining surface 12, and its outer edge is mated with and abuts the inner edge of access cover 20*a,* as in FIGS. 1 and 10, which creates the join line J, see FIG. 2, along a fine line, and along which there is no protruding hinge as was the case with the construction of Applicant's '537 patent.

Also to be understood and kept in mind as general background is that the improved construction of the present invention, as previously mentioned, is configured such that when the respective outer and inner access covers 20*a* and 20*b* are stored, as in FIG. 8, the opening previously occupied by access covers 20*a,* 20*b,* when closed, is provided for accepting tray 34*a* as seen in FIG. 9.

Figure 7:
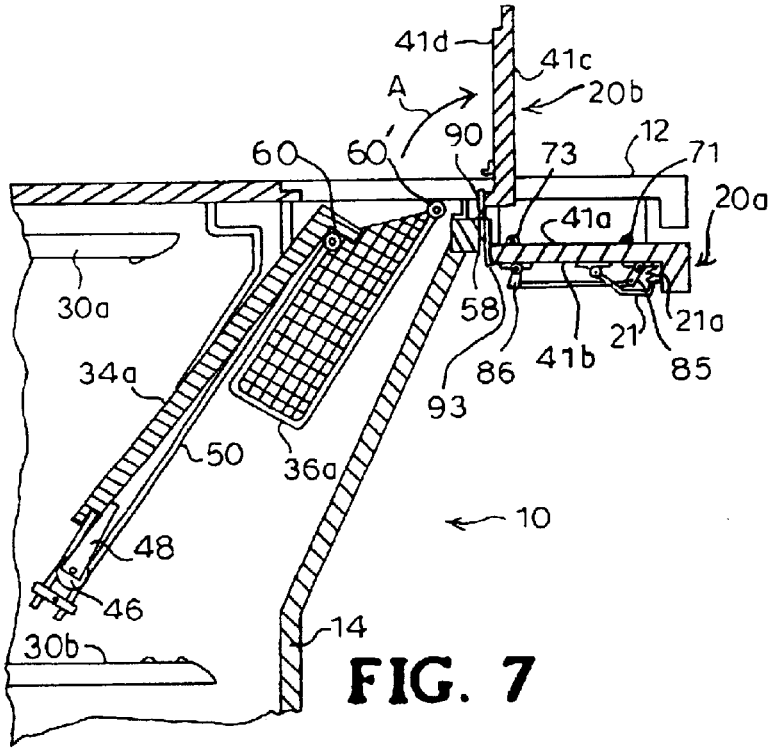
FIG. 7 is the view of FIG. 5 with the outer access cover member fully opened, the inner access cover member approximately halfway open, and an eating tray in a storage position within the dishwasher.

The improved construction also includes an arrangement explained later in detail, which enables the inner edge of access cover 20*a* when moving into its low position to engage exposed lifter tabs 93, 94 on hinge 90, which causes access cover 20*b* to tilt upwardly slightly as in FIG. 6, which facilitates grasping and upward pivoting of access cover 20*b,* to the position as illustrated in FIG. 7 and subsequently to its low position as in FIG. 8. The description now continues with a more detailed description of the just-explained general background directed to the improvements of the present invention.

Here it should again be mentioned that a specific and important object of the present invention has been that of eliminating any intrusion into the smoothness of the dining surface, such as protrusion of the hinge 54 seen in the '537 patent (see FIG. 8 of the '537 patent) when the access covers are in a coplanar, horizontal position as in FIG. 8 of the '537 patent. A primary object of the present invention is to achieve a relatively smooth hinge-free surface when the access covers are closed as illustrated in FIGS. 1 and 10.

As the more detailed description of the improved mechanism of the invention for positioning and supporting the access cover members 20*a,* 20*b* continues, it should be noted that the dining tray 34*b* and access cover members 20*c,* 20*d* can be positioned either as shown in FIG. 1, FIG. 2, or FIG. 3. When positioned as in FIGS. 1 and 2, it should be noted that the top surfaces of access cover members 20*a,* 20*b* present a substantially smooth surface on either side of a very fine, join line J (FIG. 2), and which surface can be used either as a dining surface or as a work surface. In a second mode shown in FIG. 8, access cover member 20*b,* which is hinged to a connecting bar 58, is folded so that the top surface of inner access cover member 20*b* rests on the top surface of outer access cover member 20*a* and below the level of surface 12. In this mode, an opening is formed in surface 12 equivalent in size to that vacated by the now-folded access cover members 20*a*, 20*b*. This recess receives the tray 34*a* (FIG. 9) of corresponding size as a work surface, and on which cutlery and dishes can be placed as also seen in FIG. 9. This versatile arrangement is further depicted in FIG. 1, in which access cover members 20*c*, 20*d* are assumed to be folded and replaced by tray 34*b* for use as a dining surface, whereas access cover members 20*a*, 20*b* remain in place for use as a smooth-surfaced work surface. By contrast, in FIGS. 5 and 6, access cover members 20*a* and 20*b* are partly removed from the position in which their respective top surfaces are flush with dining surface 12. In FIG. 10, outer access cover 20*a* is shown as having an outer surface 41*a* and inner surface 41*b*, whereas in FIGS. 9 and 10 inner access cover 20*b* is shown as having an outer surface 41*c* and an inner surface 41*d*.

Referring next to FIGS. 11–14, it will be seen that access cover member 20*a* mounts on its bottom surface a pair of parallel rods 56*a*, 56*b*. Rod 56*b* pivots within associated brackets 56*e*, 56*f*, and rod 56*a* pivots within associated brackets 56*c*, 56*d*, the brackets being secured by screws 56*g*. Rod 56*a* mounts on opposite ends respective levers 71, 72, and rod 56*b* mounts on opposite ends of respective levers 73, 74. Opposite ends of the respective levers 71–74 pivot on pins P extending inwardly from respective brackets 75, 76. Levers 72, 74 operate under the tension of the spring 81 and levers 71, 73 operate under the tension of the spring 80. Rods 56*a*, 56*b* operate in unison through the connecting links 87, 88. An additional rod 23 pivots in its mounting brackets 25*a*, 25*b*, 25*c*, and 25*d* and its pivotal motion responds to the latched or unlatched condition of a hand pressed pivotal lever 21.

Lever 21 is spring loaded so that upon release of lever 21, springs 21*a*, 21*b* (FIG. 11) force lever 21 back into its original position. Lever 21 is fixedly attached to rod 23, which in turn is pivotally mounted to the back or inner surface 41*b* of access cover member 20*a* by the previously mentioned brackets 25*a*, 25*b*, 25*c* and 25*d*. Brackets 25*a*, 25*b*, 25*c*, and 25*d* are fixedly attached to the inner or back surface 41*b* of access cover member 20*a* by screws 27. The outermost ends of rod 23 are L-shaped as at 27*a*, 27*b*. L-shaped ends 27*a*, 27*b* are releasably received by brackets 29*a*, 29*b* which are fixedly mounted on the underside of dining surface 12 by screws 29*c*. L-shaped ends 27*a*, 27*b* of rod 23, when latched, are normally received by brackets 29*a*, 29*b*, as in FIG. 11, until released, as in FIG. 12, by pressing lever 21.

Thus far attention has been directed to access cover member 20*a* and its operating mechanism. Attention will now briefly shift to access cover member 20*b* and its associated mechanism. Access cover member 20*b* is pivotally connected to bar 58 by hinge 90. Hinge 90 is mounted below dining surface 12 so that when table 10 is being used for food preparation food cannot get into the hinge area. One leaf portion of hinge 90 is fixedly mounted on the face of one edge of bar 58 and another leaf portion is fixedly attached to the underside of access cover 20*b*. A pair of lifter tabs 93, 94 are fixedly secured at one end to a leaf portion of hinge 90 and extend downwardly therefrom. When access cover member 20*a* is moved into its most downward position, its inner edge contacts the lower extremities of lifter tabs 93, 94, which causes access cover 20*b* to be raised a predetermined amount, as seen in FIG. 6. This raised movement of access cover 20*b* allows the user of the apparatus of the present invention to be able to easily grasp the edge of access cover 20*b* and manually raise access cover 20*b* and move it to the position of FIG. 7 and then to the position of FIG. 8.

Description will now shift to further aspects related to operation of the mechanism of the present invention. In this regard, it is again mentioned that only access covers 20*a*, 20*b* are described in detail as access cover members 20*c*, 20*d* are identical in structure and operation. Attention is next directed specifically to FIGS. 5–13.

Figure 11:
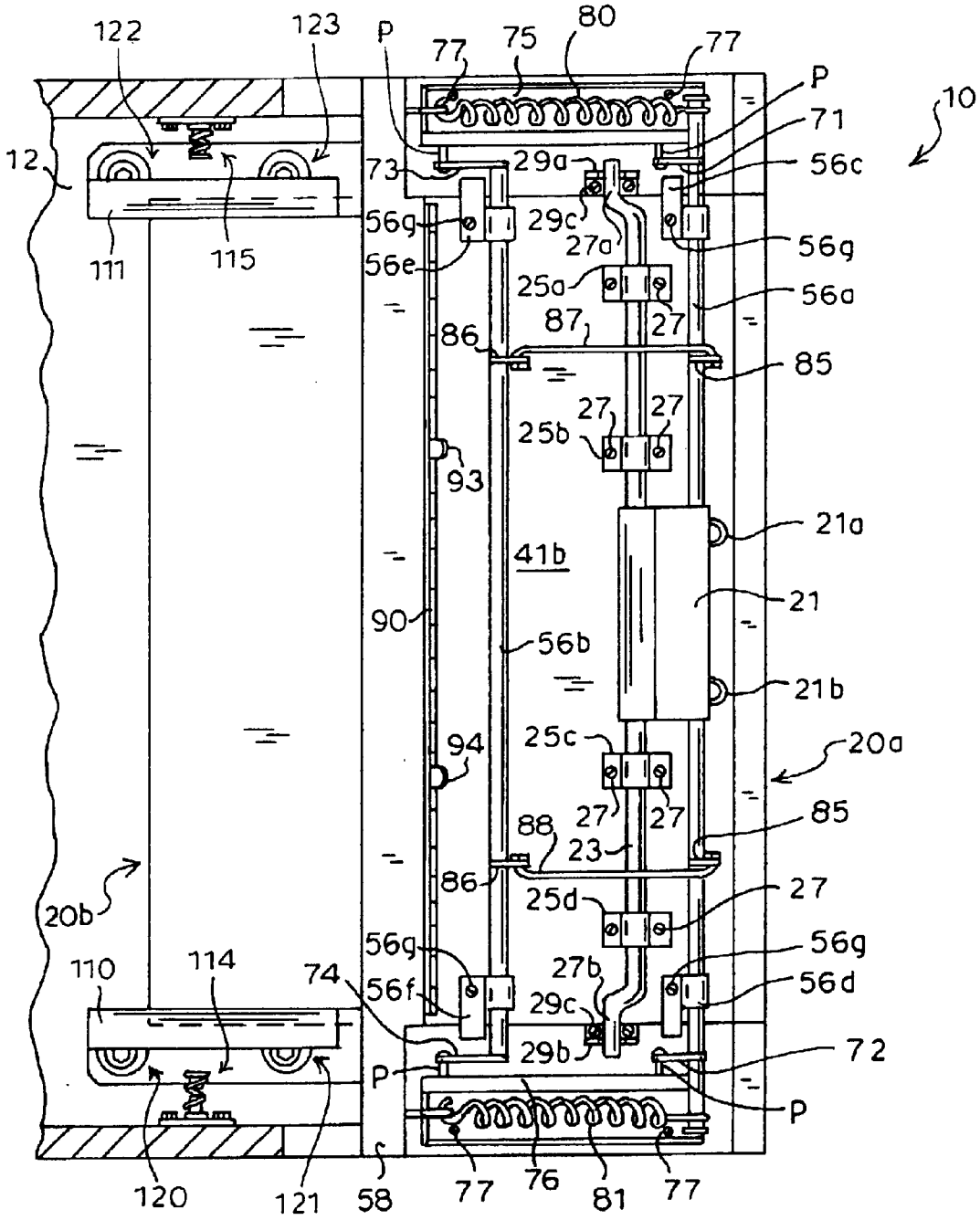
FIG. 11 is a bottom plan view of the hinge arrangement for the inner access cover and the linkage mechanism and associated apparatus for opening and closing the outer access cover and with the inner and outer access covers being shown in the fully closed position of FIG. 10.
Figure 12:
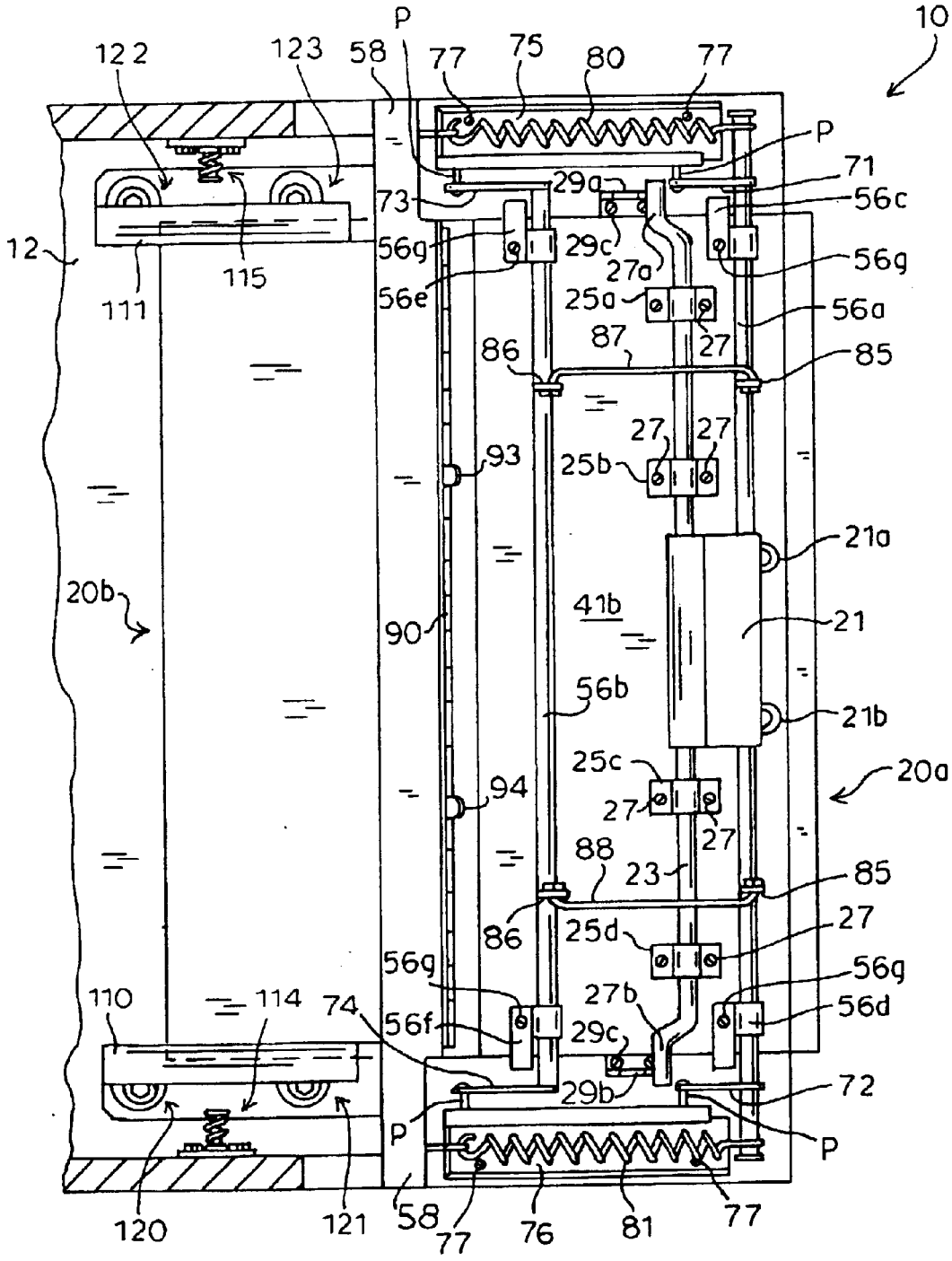
FIG. 12 is a bottom plan view of the hinge arrangement for the inner access cover and the linkage mechanism and associated apparatus for opening and closing the outer access cover with the inner access cover being shown in the partly-opened position of FIG. 6.
Figure 13:
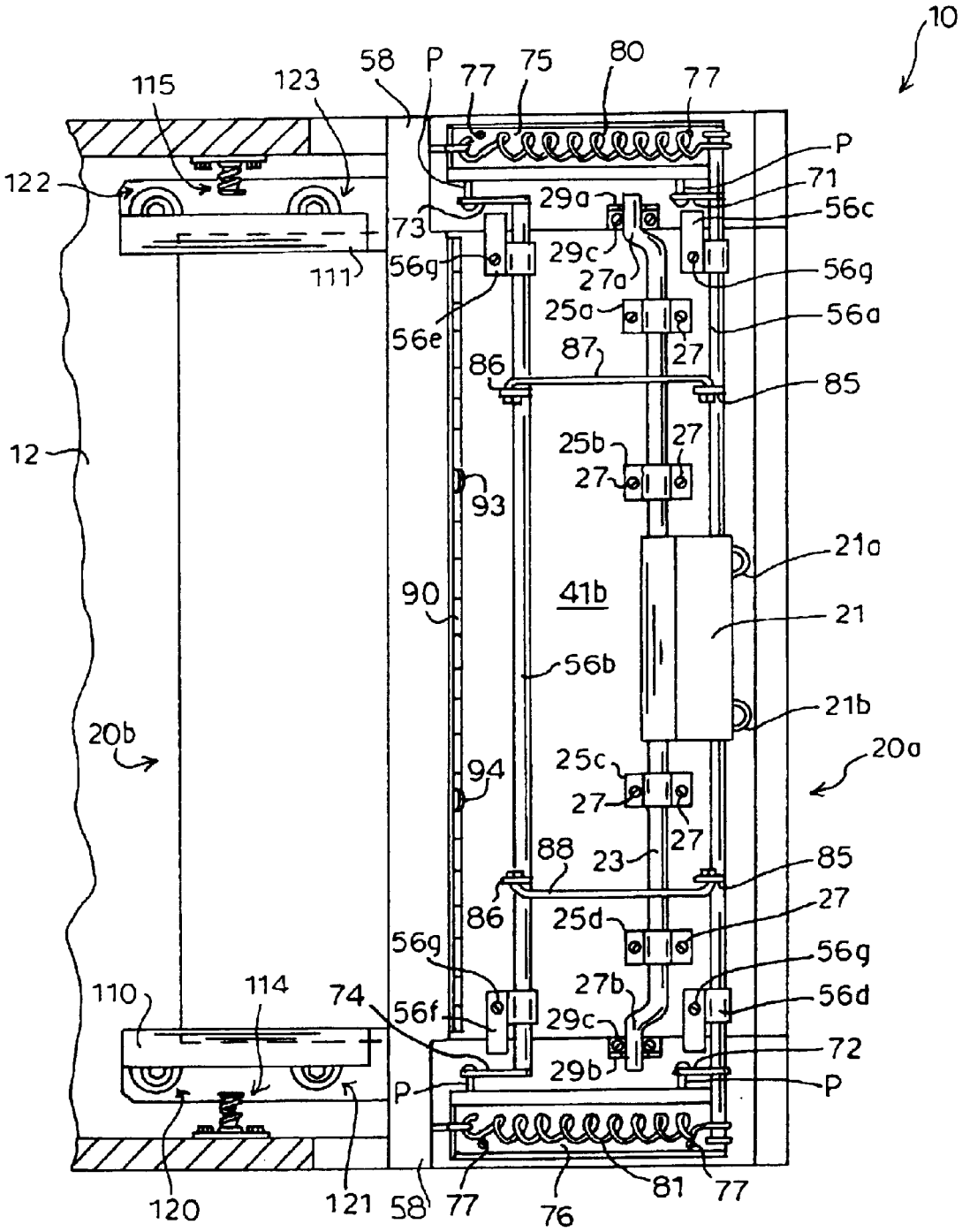
FIG. 13 is a bottom plan view of the hinge arrangement for the inner access cover and the linkage mechanism and associated apparatus for opening and closing the outer access cover with the outer and inner access covers being shown in the fully opened position of FIG. 8 so that the eating tray can be completely withdrawn from the dishwasher into an operative position for receiving dishes and utensils and eating thereon.
Figure 14:
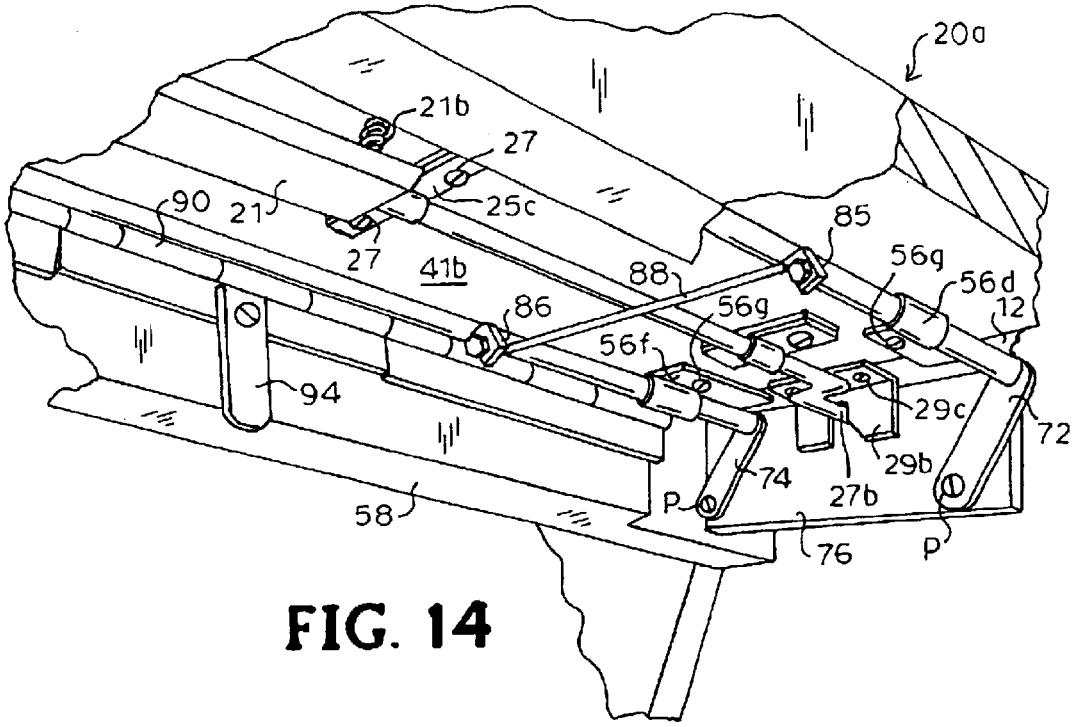
FIG. 14 is a partial, enlarged, cut-away bottom view of the apparatus shown in FIG. 11.
Figure 15:
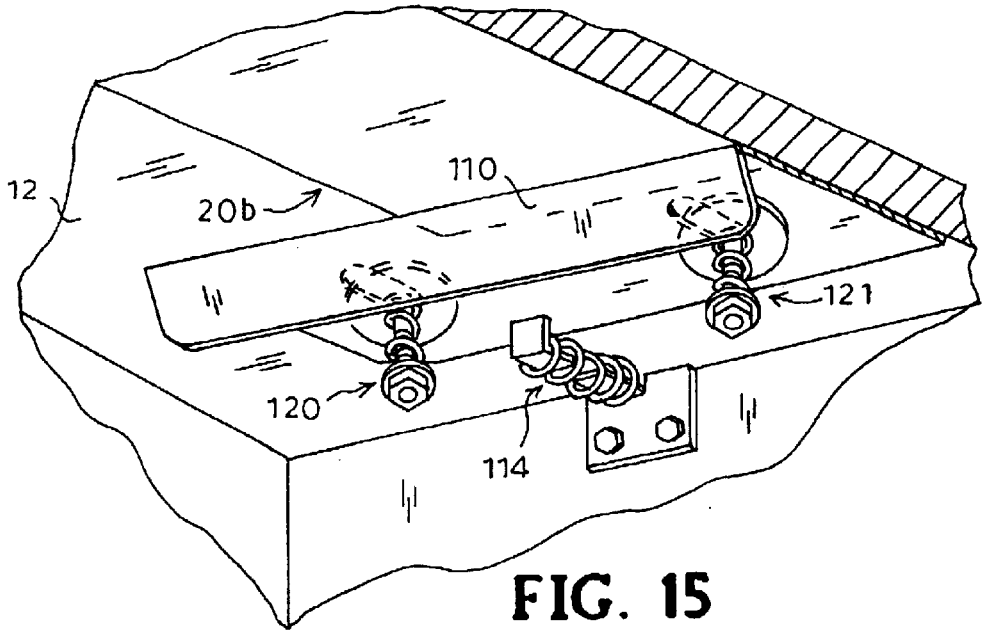
FIG. 15 is a partial, cut-away bottom view of a pair of oppositely-positioned spring-loaded spray barriers that releasably engage the edges of the eating tray and are forced to spread apart to the full width of the eating tray when it is being withdrawn and after the tray has been withdrawn are each forced inwardly under spring pressure so as to provide a spray barrier at each of the inner side portions of the opening in which the eating tray resides when being used.

The cross sectional elevation view of FIG. 10 and bottom view of FIG. 11 illustrate access cover members 20*a*, 20*b* in a closed position as shown in FIG. 1. In the positions associated with these three figures, the top surfaces of access covers 20*a*, 20*b* are flush with the top surface of dining surface 12 of the improved dining table 10. In the position being illustrated, tray 34*a* and all of the dishes are stored underneath dining surface 12, see FIG. 10. Thus, if an individual wants to remove the dishes and set the table for eating on eating tray 34*a*, he or she first grasps lever 21 and presses it inward, which in turn depresses springs 21*a*, 21*b*. As a result, L-shaped ends 27*a*, 27*b* of rod 23 are released from brackets 29*a*, 29*b*. Outer access cover 20*a* is then moved downward into the partly open position associated with that illustrated in FIG. 5 and FIG. 12. During this operation, rods 56*a* and 56*b* move into the position shown in FIGS. 5 and 12. Once lever 21 has been depressed and access cover 20*a* has begun to be moved downward, access cover 20*a* can be moved further downward to its lowermost position as illustrated in FIG. 6. When access cover 20*a* is in its lowermost position, the inner edge of access cover 20*a* contacts the exposed extremities of lifter tabs 93, 94. Once access cover 20*a* is in its lowermost position, as in FIG. 6, the inner access cover 20*b* is forced upward a predetermined small amount by lifter tabs 93, 94, see FIG. 6. The operator can easily grasp the raised edge of access cover member 20*b* and pivot it upward by grasping the forward edge thereof and raising access cover member 20*b* and moving it to the vertical position illustrated in FIG. 7. Access cover member 20*b* can then be moved further forward until it reaches the position illustrated in FIG. 8 where surface 41*a* of access cover member 20*a* and surface 41*c* (FIG. 8) of access cover member 20*b* rest against each other.

Referring now to FIG. 8, at this stage tray 34*a* is being moved from its storage and cleaning position within base 14, upwardly and outwardly in the direction of arrow B. Eating tray 34*a* has a guide 46, for example a roller, mounted to each of its lower corners (one shown) by bracket 48. Guide 46 is formed with a circumferential groove that engages track 50 to guide the movement of eating tray 34*a*. Track 50 is made of round rod material, in the preferred embodiment. Other forms of guide and track are available to accomplish similar control. A pair of stops 60, only one of which is shown in FIG. 8 are mounted to the upper inner corner (one shown) of chute 36*a* and a pair of supports 60' are mounted to the upper outer corner (one shown) of chute 36*a* to be at different heights relative to eating surface 12. As illustrated in FIG. 8, guides 60 assist in guiding the movement of eating tray 34*a* out of its storage position.

FIG. 9 shows eating tray 34*a* as it is placed to provide continuity of eating surface 12. A mortised edge M is formed on the inner edge of eating tray 34*a* and the mating edge of dining surface 12 to securely locate and support the rear of eating tray 34*a*. In this position, the middle area of eating tray 34*a* rests on support 60' and the front edge thereof rests on a mating mortised edge of inner part 41*b*, thereby securely supporting eating tray 34*a* at three points. In this operating position of eating tray 34*a*, as illustrated in FIG. 9, guide 46 has been pressed into a rearwardly extending spur portion of track 50 and is pressed against the lower surface of dining surface 12 so that dining surface 12 is substantially sandwiched between guide 46 and mortised edge M.

FIG. 10 illustrates the dining table with integral dishwasher 10 as it is ready for a washing process. Eating tray 34*a* has been returned to its storage position with guide 46 near the lower end of track 50 and the upper end of eating tray 34*a* resting on stop 60. Access cover member 20*a* is positioned flush with dining surface 12 with mortised edges M of dining surface 12 and access cover member 20*b* engaged. Access cover member 20*a* is fitted with gasket material (not shown) so as to contain spraying water coming from water distribution arms 30*a*, 30*b*. A typical set of dishes is shown in perforate chute 36*a*. A locking mechanism, previously described lever 21, springs 21*a*, 21*b*, rod 23, and brackets 29*a*, 29*b*, function to keep access cover members 20*a*, 20*b* securely held in the illustrated position to prevent accidental opening during a washing cycle and so that if downward pressure exerted on the outer end thereof does not cause access cover member 20*a* to dislodge.

When the dishwasher function operates, upper water distribution arm 30*a* sprays water in the direction of arrow C (FIG. 5) onto the exposed upper surface of eating tray 34*a*, and lower water distribution arm 30*b* sprays water in the direction of arrows D (FIG. 5) onto the exposed lower surface of eating tray 34*a* and the dishes in chute 36*a*. A further water distribution arm 30*c* sprays upwardly to wash pots in basket 32 (see FIG. 3).

It will be appreciated that after eating tray 34*a* has been positioned as in FIG. 10, there may be excess water sprayed towards the inwardly located portions of the sides of the opening in which tray 34*a* resides. Therefore, the apparatus of the invention makes provision for establishing barriers to any dishwasher spray directed towards the inwardly located portions of the sides of the opening in which tray 34*a* resides. This spray barrier apparatus is shown in FIGS. 11–13 and 15 and comprises formed sheet metal spray barriers 110, 111. Each spray barrier is mounted such that it can move towards and away from the opposite spray barrier under the tension of springs in spring assemblies 114, 115 and also so that it can also move in and out under the tension of springs 120, 121 and 122, 123. Thus, after tray 34*a* has been positioned as in FIG. 10, spray barriers are established by the spray barriers 110, 111 so as to prevent spray water from reaching the inwardly located portions of the sides of the opening.

The invention further recognizes that there are a substantial number of single person households. In such a single person situation, eating may most commonly be done at a kitchen counter rather than at a table. The present invention can be built into a counter with a single access cover and a single chute for one-side use. Such a one-sided mechanism could similarly be built into a dining table if desired.

The above detailed description of a preferred embodiment of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A combination dining table with integral dishwasher, comprising:

a) a support base having a top portion;

b) a table structure providing a substantially horizontal dining surface fixedly mounted on said support base top portion and having an opening bounded by portions of said fixed dining surface;

c) a dishwasher assembled within said support base and connected to appropriate utilities for operation thereof;

d) a perforate chute mounted within said dishwasher and configured for receiving and holding a plurality of utensils, said chute extending angularly downward from an open upper end to a closed perforate lower end thereof;

e) an openable access cover assembly comprising inner and outer access covers each of which is adapted to be positioned in either a storage position below the level of said dining surface and providing access to said dishwasher or in an enclosing position above selected portions of said dishwasher;

f) said inner access cover being supported, independent of the support provided for said outer access cover, on a fixed portion of said table structure and in a manner which enables said inner access cover to pivot on a fixed axis between its respective said storage and enclosing positions;

g) said outer access cover being supported, independent of the support provided for said inner access cover, at each of its ends by a lever arrangement suspended from a fixed portion of said table, and which enable said outer access cover to swing on said lever arrangement between its respective storage position in a first plane below said dining surface and its enclosing position in a second higher plane parallel to the first plane, and in which the upper surface of said outer access cover is flush with said dining surface; and h) said inner and outer access covers being configured to snugly fill said opening when each is in its respective said enclosing position and to permit respective adjoining edges of said inner and outer access covers to abut in a close fit join with no upstanding protrusions from the support provided for either said inner or outer access covers so as to maintain the smoothness of said dining surface within the boundaries of said opening at said join when said inner and outer access covers are in their respective enclosing positions.

2. A combination dining table with integral dishwasher as claimed in claim 1, including an eating tray configured to snugly fill said opening when said inner and outer access cover are in said storage position.

3. A combination dining table with integral dishwasher as claimed in claim 2, including means operative when said tray has been positioned for washing to establish barriers in the path of spray from said dishwasher directed toward inwardly located side portions of said opening.

4. A combination dining table with integral dishwasher as claimed in claim 1, including means enabling said outer access cover to be latched and unlatched when in its said enclosing position.

5. A combination dining table with integral dishwasher as claimed in claim 1, wherein said inner and outer access covers and opening are each of rectangular shape.

6. A combination dining table with integral dishwasher as claimed in claim 1, including means actuated by movement of said outer access cover when moving into its enclosing position and operative when so actuated to cause said inner access cover to tilt upward to a position which acts to facilitate manual grabbing of said tilted inner access cover for further movement.

7. A combination dining table with integral dishwasher as claimed in claim 1:

a) including means enabling said outer access cover to be latched and unlatched when in its said enclosing position;

b) wherein said inner and outer access covers and opening are each of rectangular shape; and c) including means actuated by movement of said outer access cover when moving into its enclosing position and operative when so actuated to cause said inner access cover to tilt upward to a position which acts to facilitate manual grabbing of said tilted inner access cover for further movement.

8. A combination dining table with integral dishwasher as claimed in claim 1, wherein:

a) said inner and outer access covers and opening are each of rectangular shape; and b) means enabling said outer access cover to be latched and unlatched when in its said enclosing position, comprising:

i) a rod member rotatably mounted on and extending the length of said outer access cover and formed as a latch at each of its ends;

ii) a hand-actuated lever adapted when pressed to rotate said rod member and thereby to rotate said latch at each end thereof; and iii) a latch receptacle fixedly mounted at each of opposite ends of said rod member and adapted to releasably receive and latch each said latch when said rod member lever positions each said latch to be received by said latch receptacle and adapted to release said latch when said lever positions said rod for release therefrom.

9. A combination dining table with integral dishwasher as claimed in claim 1, wherein said lever arrangement comprises:

a) a pair of laterally-spaced rods rotatably mounted on a bottom surface of said outer access cover;

b) levers each having an end thereof mounted on an end of each said rod and rotatable therewith; and c) fixed mounts rotatably mounting opposite ends of each of said levers.

10. A combination dining table with integral dishwasher as claimed in claim 1, wherein said opening is one of a pair of openings within the boundaries of each of which is mounted a said openable access cover assembly.

11. A combination dining table with integral dishwasher as claimed in claim 1, wherein an inner portion of said opening overlies and provides access for loading and unloading said dishwasher and an outer portion of said opening overlies the said storage portion of said inner and outer access covers and provides access thereto.

* * * * *